United States Patent [19]

Cahoon

[11] Patent Number: 5,049,034

[45] Date of Patent: Sep. 17, 1991

[54] PROPELLER HUB ASSEMBLY

[75] Inventor: William L. Cahoon, Winter Haven, Fla.

[73] Assignee: Mach Performance, Inc., Lake Hamilton, Fla.

[21] Appl. No.: 433,747

[22] Filed: Nov. 9, 1989

[51] Int. Cl.[5] ..... B63H 1/20

[52] U.S. Cl. ..... 416/134 R; 416/244 B; 416/500

[58] Field of Search ..... 416/93 A, 93 R, 142, 416/245 A, 244 B, 500, 134 R

[56] References Cited

U.S. PATENT DOCUMENTS

| | | | |
|---|---|---|---|
| 2,948,252 | 8/1960 | Alexander, Jr. | 416/93 A |
| 3,279,415 | 10/1966 | Kiekhaefer | 416/93 A |
| 3,587,510 | 6/1971 | Shimanckas | 115/35 |
| 3,937,093 | 2/1976 | Johnson et al. | 74/417 |
| 4,112,866 | 9/1978 | Liaaen | 115/34 |
| 4,276,036 | 6/1981 | Nishida et al. | 440/89 |
| 4,317,655 | 3/1982 | Schiek | 440/78 |
| 4,486,181 | 12/1984 | Cavil | 440/49 |
| 4,498,874 | 2/1985 | Pichl | 440/83 |
| 4,604,068 | 8/1986 | Guinn | 440/76 |
| 4,689,027 | 8/1987 | Harada et al. | 440/75 |
| 4,798,548 | 1/1989 | Higby et al. | 440/78 |
| 4,826,404 | 5/1989 | Zwichy | 416/93 A |
| 4,842,483 | 6/1989 | Geary | 416/93 A |

*Primary Examiner*—John T. Kwon
*Attorney, Agent, or Firm*—James H. Beusse

[57] ABSTRACT

A propeller hub assembly comprises a driven member having an outer cylindrical housing and an inner cylindrical housing. The inner cylindrical housing is coaxially fixedly coupled and radially spaced from the outer cylindrical housing, and includes a plurality of radially inwardly directed circumferentially spaced ribs oriented parallel to an axis of the inner cylindrical housing. The propeller hub assembly further includes a driving member which comprises a cylindrical member having an axis of rotation. An opening passes through the driving member coaxial with the axis of rotation and is adapted for receiving a drive shaft. The driving member further includes a plurality of radially outwardly extending ribs oriented parallel to the axis of rotation and terminating radially at a diameter substantially equal to an inner diameter of the inner cylindrical housing. The outwardly extending ribs of the driving member intermesh with the inwardly extending ribs of the inner cylindrical housing when the driving member is inserted into the inner cylindrical housing. The propeller hub assembly also includes a plurality of resilient rod-shaped elements for inserting into the inner cylindrical housing with the driving member. At least one of the plurality of rod-shaped elements is positioned between each adjacent one of the ribs of the driving member and the inner cylindrical housing for absorbing shock loading during torque transfer between the driving member and the driven member.

6 Claims, 1 Drawing Sheet

PROPELLER HUB ASSEMBLY

The present invention relates to propeller hub assemblies for high performance marine craft.

BACKGROUND OF THE INVENTION

Pleasure boats can be grouped into at least three different categories by application and engine power. The lowest power boats are typically used for fishing and water skiing and have engines in the range of 25 to 150 horsepower. The middle category is generally classified as a sport boat and uses one or more engines in the 150 to 300 horsepower range. Boats using engines in excess of 300 horsepower are typically racing boats. Boats as defined above may exclude some cabin cruisers, yachts, and other ocean going vessels.

Boats which fall into the lowest and middle power ranges utilize engines which drive a propeller through a transmission as compared to the race boat category in which the engine is always driving the propeller through a direct drive. The boat transmission historically provides only for forward, reverse, and neutral and does not incorporate a clutch. Accordingly, shifting occurs under power, desirably at engine idle, and results in a significant shock load in the components of the drive system. On very low horsepower drives where the rotating propeller and hub assembly have relatively low mass, the shock load effect is usually acceptable. In this size category, the propeller hub assembly is usually pinned to the drive shaft with a "shear" pin. This pin can absorb the shock load of forward to reverse shifting but is designed to shear and allow the hub assembly to spin free if the propeller strikes an object, such as a log, in the water. The shear pin thus provides a degree of protection for the drive assembly, i.e., the engine transmission and drive shaft, of smaller horsepower systems.

As engines became larger, and hub assemblies more massive, it was necessary to develop an apparatus to absorb the greater shock loading during shifting and to replace the shear pin which could now be "sheared" by engine torque unless made so large that it became ineffective in preventing damage when an object was struck. The apparatus developed incorporated an elastomeric coupling between the propeller hub and the engine drive shaft. A drive member having a central aperture for fitting onto the drive shaft included an outer annular rubber element bonded to the drive member. The central aperture has a plurality of alternating grooves and ridges running axially to provide a non-slip connection via corresponding mating grooves and ridges on the drive shaft. The drive member is press-fit into an outer driven member to which propeller blades are attached. The coupling between the driven member and the drive member thus comprises the annular elastomeric element attached to the drive member. In practice, the press-fit may require as much as eight tons compression to compress the rubber element into the outer cylindrical driven hub member. The rubber element absorbs the shock loading during transmission shifting and also provides a break-away connection in the event that the propeller strikes an object.

The elastomeric coupling system has become an industry standard. Unfortunately, this system has been found to have disadvantages as horsepower available for pleasure boats has increased. When the elastomeric coupling was first developed, most pleasure boats used engines of less than 100 horsepower. When engine horsepower exceeds about 200 horsepower, it has been found that the impact of propeller blades on water at high torque levels generates sufficient force to cause slipping of the outer hub about the elastomeric coupling. Once any slipping has occurred, the efficacy of the coupling is severely downgraded. While power can still be generated in many cases by proceeding at slow speed, a slipped coupling requires replacement. Since this type of coupling appears to be limited to use below about 200 horsepower, it is desirable to provide a propeller hub assembly which can be used with higher horsepower sport boats.

SUMMARY OF THE INVENTION

Among the several objects, features, and advantages of the present invention is the provision of a propeller hub assembly which overcomes the above and other disadvantages of the prior art; the provision of a propeller hub assembly which provides shock absorbency without press-fitting; the provision of a propeller hub assembly which can absorb shock loading without slipping; and the provision of a propeller hub assembly which can be repaired without special tools.

The above and other objects are attained in a propeller hub assembly comprising an internal drive member which has a cylindrical tube shaped portion including a preselected inner diameter and a preselected outer diameter. The inner diameter defines an inner axial aperture adapted for receiving a drive shaft. This aperture is formed with a plurality of axially oriented alternating grooves and ridges for establishing a non-slip connection to the drive shaft. The drive member also includes a plurality of circumferentially external radial ribs which extend axially over at least a portion of the member. The drive member further includes a reduced outer diameter extending over a portion thereof adjacent one end.

An outer driven member comprises an outer cylindrical housing which includes an outer surface adapted for attachment of a plurality of propeller blades, an inner cylindrical housing coaxial with the outer cylindrical housing, a plurality of radial fins extending between an inner surface of the outer housing, and an outer surface of the inner housing for fixedly coupling the inner housing to the outer housing with a preselected space therebetween.

The inner cylindrical housing includes a plurality of radially inwardly extending ribs oriented parallel to an axis of the inner housing with an inner diameter corresponding to the outer diameter of the internal drive member. The internal drive member will then slip inside the inner housing with the inwardly extending ribs meshing with the external ribs. The ribs of the inner housing and the internal drive member are circumferentially sized to permit insertion of resilient rods between adjacent sides of the ribs so that the rods provide shock absorbency between the drive member and the driven member.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
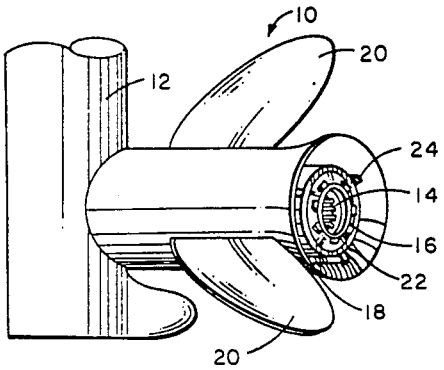
FIG. 1 (PRIOR ART)
FIG. 1 is a partial elevation view of a propeller hub assembly.

Referring now to FIG. 1, there is shown a perspective view of a propeller hub assembly 10 attached in driving relationship with an outboard drive housing 12. The housing 12 has been shown only in partial view but will be recognized to be a standard housing of a type well known in the art. A drive shaft 14 can be seen extending from an end of the propeller assembly 10. A nut 16 screwed on a threaded end of the drive shaft 14 serves to hold the assembly 10 onto the drive shaft. The propeller hub assembly 10 includes an outer cylindrical housing 18 to which is welded or otherwise attached a plurality of propeller blades 20. In general, the propeller hub assembly includes an inner cylindrical housing 22 coaxial with the outer cylindrical housing 18 when spaced radially therefrom. The inner housing 22 is supported within the outer housing 18 by a plurality of circumferentially spaced ribs 24. The space between the inner and outer housings is used for an exhaust opening for exhaust gases from the engine driving the propeller. For that reason, the size of the inner housing 22 is limited by the size of the outer housing 18. The size of the outer housing 18 is limited by the size of the gear case or housing 12 both by stream lining requirements and available power to the hub assembly.

Figure 3:
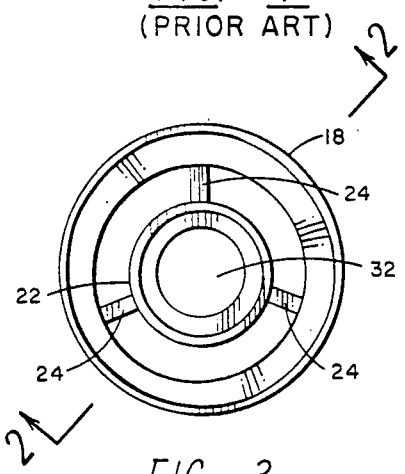
FIG. 3 (PRIOR ART)
FIG. 3 is a plan view of a propeller hub of the prior art.
Figure 2:
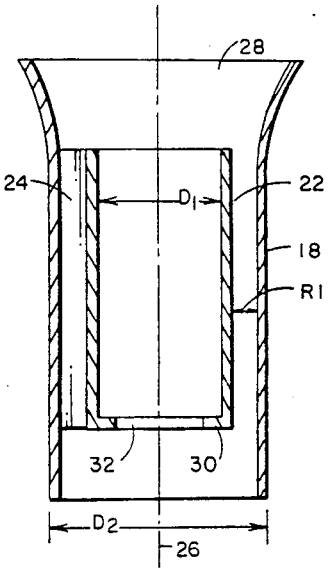
FIG. 2 (PRIOR ART)
FIG. 2 is a cross-sectional view of a propeller hub of the prior art.

Referring now to FIG. 2, there is shown a cross-sectional view of the inner and outer housings 18 and 22 of the hub assembly 10. In this figure, it can be seen that both the inner housing 22 and outer housing 18 are coaxial about an axis of rotation 26. Both housing 18 and housing 22 are essentially tubular cylindrical housings. The housing 18 has a slightly flared upper or outer end 28 which aids in dispersion of exhaust gases. The inner housing 22 has a lower end with a radially extending flange 30 defining a reduced diameter opening 32. The inner housing 22 has a preselected inner diameter $D_1$ which is determined by the amount of space $R_1$ required between the inner and outer housings 22, 18, respectively, and the limit to the outer diameter $D_2$ of the outer cylinder 18. The inner diameter $D_1$ is also restricted by the required thickness of the inner housing 22 and outer housing 18 in order to support the torque on the hub assembly. FIG. 3 is a bottom view of the inner and outer housings 18 and 22 of FIG. 2 and illustrates the reduced diameter opening 32 along with the ribs 24 supporting the inner housing 22 within the outer housing 18.

Figure 4:
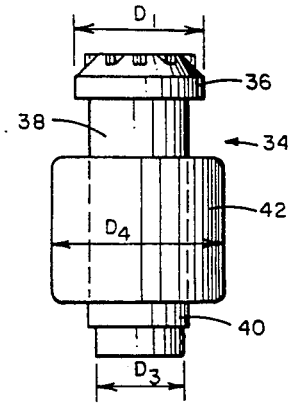
FIG. 4 is an elevation view of a propeller shaft to propeller hub coupling of the prior art.
Figure 5:
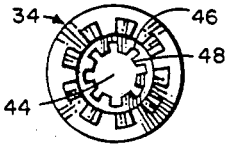
FIG. 5 (PRIOR ART)
FIG. 5 is a plan view of the coupling of FIG. 4.

FIG. 4 illustrates an elevation view of a drive member 34 which fits within the inner diameter of the inner cylinder 22. The drive member 34 comprises a substantially tubular casting having an upper end 36 having an outer diameter substantially equal to the diameter $D_1$ of the inner housing 22. The major extent 38 of the drive member 34 is of a diameter less than the diameter $D_1$. At the lower end of the member 34 there is provided a reduced diameter extension or guide 40 having a diameter $D_3$ substantially the same as the diameter of the reduced diameter opening 32. When the drive member 34 is inserted within the inner housing 22, the upper portion 36 and the lower portion 40 serve to position the drive member 34 coaxially within the inner housing 22. Visibly bonded to the major extent 38 of the drive member 34 is a rubber or elastomeric annular element 42. The elastomeric 42 is a compressible material having an outside diameter $D_4$ which is greater than the inside diameter $D_1$ of housing 22. The elastomeric material of element 42 is relatively stiff such that it requires approximately eight tons of pressure to compress the material to the diameter $D_1$. When compressed, the drive member 34 may be inserted within the housing 22 such that the ends 36 and 40 provide centering of the drive element while the compressible elastomeric element 42 provides coupling between the drive member 34 and the inner housing 22. FIG. 5 is a top view of element 34 showing the inner central aperture 44 containing alternate circumferentially spaced grooves 46 and ridges 48. The grooves and ridges 46, 48 intermesh and mate with corresponding grooves and ridges on the drive shaft 14. Thus, there is a fixed locked relationship between the member 34 and the drive shaft 14 while there is a elastomeric coupling between the drive member 34 and the propeller hub 18.

The prior art as described in FIG. 1-5 has been very effective in providing shock absorbency between the propeller hub assembly 10 and the drive mechanism 12. However, as previously discussed, when the horsepower of the drive assembly begins to exceed about 200 horsepower, the torque generated at the elastomeric coupling 42 is such that the mere hitting of the water by the propeller blades 20 may result in slippage between the coupling element 42 and the inner surface of the inner housing 22. Once slippage has occurred, the surface of the coupling element 42 overheats and changes its characteristics such that additional slippage becomes more common. In general, once slippage has occurred, it becomes necessary to replace the inner driving member 34 in order to again realize the power capabilities of the drive 12.

Figure 6:
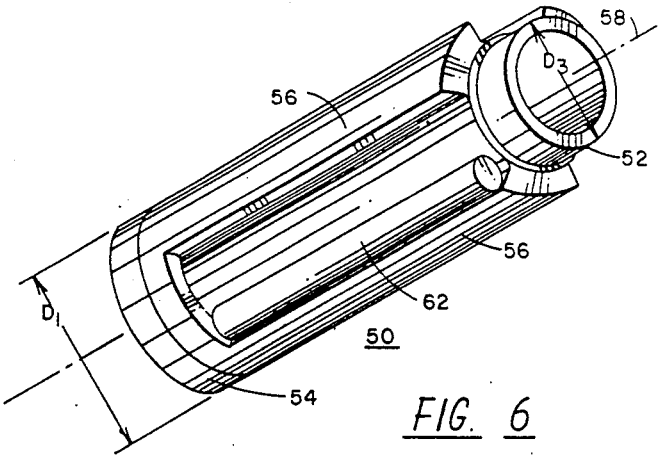
FIG. 6 is a propeller shaft coupling according to the present invention.

Turning now to FIG. 6, there is shown an internal drive member 50 in accordance with one form of the present invention. FIG. 6 is a perspective view of the drive member 50 from its lower end. The member 50 includes the neck down portion or guide 52 having an outer diameter $D_3$ the same as portion 40 of drive member 34. At the opposite end of the drive member 50 there is an annular enlarged area 54 having an outer diameter $D_1$ the same as diameter $D_1$ of portion 36 of drive member 34. Extending over the major extent of drive member 50 between the end portion 54 and the end portion 52, is a reduced diameter section which includes a plurality of radially extending ribs 56 running coaxially along the length of the major portion of the drive member and parallel to the axis line 58.

The ribs 56 on the outside surface of the driving member 50 are designed to provide a direct drive connection between the drive member 50 and the inner housing 22 of the outer hub assembly or driven member of the hub assembly. In order to accommodate these ribbed projections 56, the inner housing 22 is modified by incorporating a plurality of circumferentially spaced ribs which mesh into and cooperate with the ribs 56 to provide a driving engagement between the drive member 50 and the inner housing.

Figure 7:
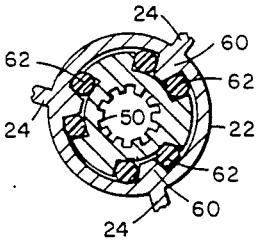
FIG. 7 is a partial cross-sectional view of a propeller hub and coupling in accordance with the present invention.

Turning now to FIG. 7, there is shown a cross-sectional view taken through a modified inner housing 22 in which drive member 50 has been installed. The modified inner housing 22 is indicated as 22' and includes a plurality of radially inwardly extending ribs 60 sized to fit within the spaces between the radially outward extending ribs 56 of drive member 50. Positioned between each of the adjacent sides of the ribs 56 and 60 are elongated circular elastomeric rods 62. The rods 62 are preferably formed of a urethane material and have sufficient resiliency to prevent contact between the adjacent surfaces of the ribs 56 and 60. Referring briefly to FIG. 6, there is shown one of the rods 62 positioned adjacent one of the sides of a rib 56 in the manner illustrated in FIG. 7. Returning to FIG. 7, the sizing of the ribs 60 and 56 and the rods 62 such that a relatively tight fit is provided between the driving member 50 and the inner housing 22'.

In operation, any shock transmitted between the propeller hub assembly and the drive member 50 is coupled through the elastomeric ribs 62 which act as shock absorbers. While the ability to slip, which is a characteristic of the prior art assembly believed to be desirable in order to protect the drive system of the engine, has been eliminated, it is believed that this slipping ability would not be advantageous in the high speed, high performance drives in the 150 to 300 horsepower class. In particular, in this class, the hub assembly may weigh in the range of fifteen to twenty pounds and be rotating at as much as 3500 Rpm. With this mass and at this speed, the shock transmitted through the hub assembly when a log or other object is hit in the water would result in the hub assembly attempting to wrap itself around the object in the water and thus damage both the drive assembly and hub before slipping could actually occur. Furthermore, as was described above, the ability of the elastomeric coupling of the prior art to withstand the shock transmitted from water impact is not sufficient to prevent slipping even when no objects are encountered.

One advantage of the present invention is the ease of assembly and disassembly of the propeller hub assembly. The fit between the inner drive member and the inner housing 22' is such that the drive member 50 may be easily removed and inserted into the inner cylinder. Such assembly and disassembly may be desirable after extended use when the elastomeric rods 62 have been repeatedly compressed so that some degree of play or backlash exists between the outer hub assembly and the drive member 50. In such a case, the hub assembly may be removed from the engine and disassembled in order to replace the elastomeric rods 62. The size of the ribs 56 and ribs 60 may be chosen such that the amount of compressible space between the adjacent ribs to be filled by the elastomeric rods 62 will allow for as much as 45° rotation of the propeller outer housing 18 with respect to the drive member 50. In cases where the function of the elastomeric rod is merely to absorb shock during shifting, this amount of rotation is sufficient to protect the engine drive components. In the event that the propeller blades strike an object, the 45° rotation may be sufficient for smaller objects to allow the propeller blades to absorb the impact without transferring the impact directly to the engine drive assembly.

While the invention has been described in what is presently considered to be preferred embodiment, other variations and modifications will become apparent to those having ordinary skill in the art. Accordingly, it is intended that the invention not be limited to the specific embodiment but be interpreted within the full spirit and scope of the appended claims.

What is claimed is:

1. A propeller hub assembly comprising:

an internal drive member having a cylindrical tube shaped portion having a preselected inner diameter and a preselected outer diameter, the inner diameter defining an inner axial aperture adapted for receiving a drive shaft, the aperture being formed with a plurality of axially oriented alternating grooves and ridges for establishing a non-slip connection to the drive shaft, the drive member further including a plurality of external radial ribs extending axially over at least a portion of the member, said ribs being uniformly spaced about the member and having an outer diameter corresponding to said preselected outer diameter, said member further including a reduced outer diameter extending over a portion thereof adjacent one end of said member;

a plurality of solid cylindrical rods formed of a resilient material, said rods having a length approximating the axial extent of said ribs on said drive member, and said rods having a diameter approximating the radial extent of said ribs from said member; and an outer driven member comprising an outer cylindrical housing having an outer surface adapted for attachment of a plurality of propeller blades, an inner cylindrical housing coaxial with said outer cylindrical housing, a plurality of radial fins extending between an inner surface of said outer cylindrical housing and an outer surface of said inner cylindrical housing for fixedly coupling said inner cylindrical housing to said outer cylindrical housing with a preselected spacing therebetween, said fins extending a preselected axial distance between said inner and outer housings, said inner cylindrical housing including a plurality of radially inwardly extending ribs oriented parallel to an axis of said inner housing, said inner housing having an inner diameter corresponding to said outer diameter of said internal drive member whereby said internal drive member will slip inside said inner cylindrical housing with said radially inwardly extending ribs meshing with said external radial ribs of said internal drive member, said ribs of each of said inner cylindrical housing and said internal drive member being circumferentially sized to permit insertion of said resilient rods between adjacent sides of said ribs, said rods providing shock absorbency between said drive member and said driven member.

2. The propeller hub assembly of claim 1 wherein said inner cylindrical housing includes a radially inwardly extending circumferential flange at one end thereof, said flange forming a reduced diameter opening at said one end, said opening diameter corresponding to said reduced outer diameter of said internal drive member such that said drive member is guided into axial alignment with said inner cylindrical housing by a slip fit between said opening and said reduced outer diameter portion of said internal drive member.

3. The propeller hub assembly of claim 2 wherein an end of said internal drive member opposite said reduced diameter portion includes a circumferential flange having a diameter substantially equal to the inner diameter of said inner cylindrical housing such that said opposite end thereof is axially aligned in said inner housing by a slip fit between said opposite end of said drive member and said inner diameter of said inner housing.

4. The hub assembly of claim 1 wherein said plurality of ribs on each of said inner cylindrical housing and said internal drive member comprises three ribs.

5. The hub assembly of claim 4 wherein said plurality of rods comprises six rods.

6. A propeller hub assembly comprising:

a driven member having an outer cylindrical housing and an inner cylindrical housing, said inner cylindrical housing being coaxially fixedly coupled and radially spaced from said outer cylindrical housing, said inner cylindrical housing further including a plurality of radially inwardly directed circumferentially spaced ribs oriented parallel to an axis of said inner cylindrical housing;

a driving member comprising a cylindrical member having an axis of rotation, an opening passing through said driving member coaxial with said axis of rotation and adapted for receiving a drive shaft, said driving member further including a plurality of radially outwardly extending ribs oriented parallel to said axis of rotation and terminating radially at a diameter substantially equal to an inner diameter of said inner cylindrical housing, said outwardly extending ribs of said driving member intermeshing with said inwardly extending ribs of said inner cylindrical housing when said driving member is inserted into said inner cylindrical housing; and a plurality of resilient rod-shaped elements for inserting into said inner cylindrical housing with said driving member, at least one of said plurality of rod-shaped elements being positioned between each adjacent one of said ribs of said driving member and said inner cylindrical housing for absorbing shock loading during torque transfer between said driving member and said driven member.

* * * * *